US007174570B2

(12) United States Patent
Dabney et al.

(10) Patent No.: US 7,174,570 B2
(45) Date of Patent: Feb. 13, 2007

(54) WATER-RESISTANT APRON WITH ATTACHED TOWEL

(76) Inventors: Nancy L. Dabney, 18915 Fairfield, Detroit, MI (US) 48221; Armand R. Dabney, 18915 Fairfield, Detroit, MI (US) 48221

( * ) Notice: Subject to any disclaimer, the term of this patent is extended or adjusted under 35 U.S.C. 154(b) by 0 days.

(21) Appl. No.: 11/259,152

(22) Filed: Oct. 27, 2005

(65) Prior Publication Data

US 2006/0090237 A1 May 4, 2006

Related U.S. Application Data

(60) Provisional application No. 60/624,079, filed on Nov. 1, 2004.

(51) Int. Cl.
*A41D 13/04* (2006.01)

(52) U.S. Cl. ..... 2/48; 2/51

(58) Field of Classification Search ..... 2/46, 2/48, 49.1–49.5, 51, 52, 50, 107, 114, 119, 2/120, 102, 74, 75, 80, 105, 106, 104, 463; D2/860–864

See application file for complete search history.

(56) References Cited

U.S. PATENT DOCUMENTS

| | | | | | |
|---|---|---|---|---|---|
| 1,193,545 | A | * | 8/1916 | Hart | 2/51 |
| 1,432,249 | A | | 10/1922 | Hoyme | |
| 1,609,332 | A | * | 12/1926 | Van Nest | 2/48 |
| 1,647,385 | A | * | 11/1927 | Voorsanger | 2/48 |
| 2,620,475 | A | | 3/1952 | Legg | |
| 2,648,845 | A | * | 8/1953 | Berman | 2/48 |
| 2,706,817 | A | | 4/1955 | Schneider | |
| 2,766,454 | A | * | 10/1956 | Rice | 2/48 |
| 2,879,514 | A | | 3/1959 | Shapiro | |
| 2,988,745 | A | * | 6/1961 | Whitley et al. | 2/48 |
| 3,066,307 | A | * | 12/1962 | Loewe | 2/74 |
| 3,428,962 | A | * | 2/1969 | Slimovitz | 2/48 |
| 3,879,762 | A | * | 4/1975 | Herman | 2/48 |
| 4,639,946 | A | * | 2/1987 | Koenig | 297/465 |
| 4,685,154 | A | | 8/1987 | Smith | |
| 4,873,725 | A | | 10/1989 | Mitchell | |
| D355,295 | S | * | 2/1995 | Berni | D2/740 |
| 5,640,715 | A | * | 6/1997 | Adams | 2/46 |
| D398,140 | S | | 9/1998 | Lion | |
| D412,049 | S | | 7/1999 | Shelton | |

(Continued)

FOREIGN PATENT DOCUMENTS

| | | |
|---|---|---|
| GB | 2297022 | 7/1996 |

(Continued)

*Primary Examiner*—Amy B. Vanatta
(74) *Attorney, Agent, or Firm*—Richard C. Litman

(57) ABSTRACT

The water-resistant apron with attached towel includes an apron formed of a water-resistant material, which is worn by the user. The apron is formed from a front apron portion and, preferably, also a rear apron portion, with a first releasable fastener being disposed on the front apron portion. A towel formed of water-absorbent material is further provided, and the towel has a second releasable fastener disposed thereon. The first releasable fastener on the apron releasably engages the second releasable fastener on the towel, allowing the user to selectively attach and detach the towel from the apron. The towel further includes a pair of straps, allowing the towel to be wrapped and tied around the user when the towel is attached to the apron.

4 Claims, 3 Drawing Sheets

U.S. PATENT DOCUMENTS

| | | | | |
|---|---|---|---|---|
| 5,956,762 | A | 9/1999 | Adams | |
| 6,216,269 | B1 * | 4/2001 | Smith et al. | 2/46 |
| 6,594,829 | B1 | 7/2003 | Turkheimer | |
| 6,617,487 | B2 * | 9/2003 | Chou | 2/49.1 |
| 6,820,281 | B2 * | 11/2004 | Mariland et al. | 2/115 |
| 2001/0034890 | A1 * | 11/2001 | Levas | 2/48 |
| 2003/0079267 | A1 | 5/2003 | Dugan | |
| 2003/0135908 | A1 | 7/2003 | Turkheimer | |
| 2005/0066405 | A1 * | 3/2005 | Babiak | 2/48 |

FOREIGN PATENT DOCUMENTS

| | | |
|---|---|---|
| JP | 01262814 | 10/1989 |
| WO | WO03/099048 A2 | 12/2003 |

* cited by examiner

WATER-RESISTANT APRON WITH ATTACHED TOWEL

CROSS-REFERENCE TO RELATED APPLICATION

This application claims the benefit of U.S. Provisional Patent Application Ser. No. 60/624,079, filed Nov. 1, 2004.

BACKGROUND OF THE INVENTION

1. Field of the Invention

The present invention relates to wearing apparel and garments, and particularly to a water-resistant apron with an attached towel. The water-resistant apron and the towel include releasable fastening elements, allowing the user to selectively attach and detach the towel from the, apron.

2. Description of the Related Art

Delivering baths to infants, toddlers, invalids and the like often results in accidentally and inadvertently splashed water, which can cause discomfort to the person who is delivering the bath, and possibly stain or ruin the user's clothing. A wide variety of aprons and coveralls have been used to protect clothing. Such aprons are typically formed of a water-resistant material, which covers part or all of the user's clothing.

When bathing a subject, such as a child or invalid, a towel is necessary for drying the person once the bath is finished. Some persons, however, require the user's full attention and, thus the towel must be positioned close to the caregiver, as the user cannot divert his or her attention from the person being bathed. Positioning the towel on the floor or on a nearby rack in the bathroom, however, can be unsanitary, so it is best for the caregiver to keep the towel with himself or herself during the delivery of the bath. However, the caregiver typically needs both hands to bathe the person under his care, and draping the towel around himself or herself may result in the towel accidentally falling on the floor or into the bathtub.

Although combination apron/towels have been used in the past, such systems typically include a one-piece unitary body formed of water-absorbent material, which may be worn as an apron or alternately used as a towel. Because of the material required to form an effective absorbent towel, such systems do not provide adequate protection for the user's clothing from water. Further, in order to use such a system as a towel for someone other than the wearer, the apron must first be removed in order to be used as a towel. This is both unsanitary for the person being bathed, as the towel was worn by the user as an apron, and the caregiver's clothing is left unprotected when the apron is used as a towel.

Thus, a water-resistant apron with attached towel solving the aforementioned problems is desired.

SUMMARY OF THE INVENTION

The water-resistant apron with attached towel includes an apron formed of a water-resistant material, which is worn by the user. The apron is formed from a front apron portion and a rear apron portion, with a first releasable fastener being secured to the front apron portion. Further, each apron portion includes a pair of side straps, for adjustably and releasably securing the apron about the user. The side straps of the front and rear apron portions may be tied together, or may include releasable closures, such as hook and loop fasteners, for example. An opening is formed through an upper end of the apron for receiving the user's neck and head.

A towel formed of water-absorbent material is further provided, and the towel has a second releasable fastener secured thereto. The first releasable fastener on the apron releasably engages the second releasable fastener on the towel, allowing the user to selectively attach and detach the towel from the apron. The releasable fasteners may be snap fasteners, hook and loop fasteners, or any other suitable fasteners. The towel further includes a pair of straps, allowing the towel to be wrapped and tied around the user when the towel is attached to the apron, so that the towel is not left hanging freely.

Further, the apron may include one or more pockets for holding bath related items or the like, and the apron may have decorative or informative indicia formed thereon.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
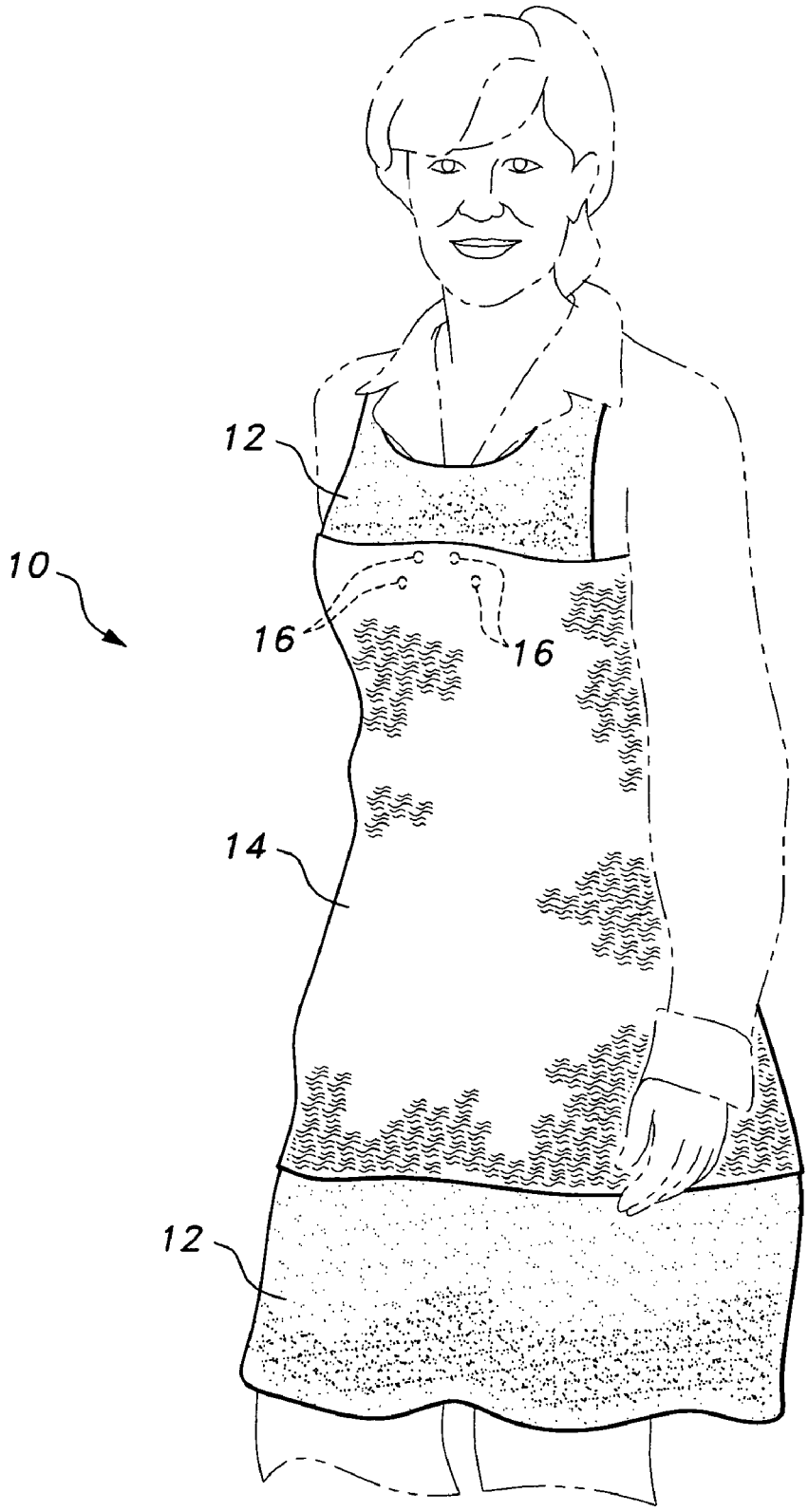
FIG. 1 is an environmental, perspective view of a water-resistant apron with attached towel according to the present invention.

Referring to FIG. 1, there is shown an apron 12 with attached towel 14, the entire combination being designated generally as 10. Apron 12 is formed from a water-resistant material, such as tightly woven cotton or similar materials, and protects the caregiver and the caregiver's clothing from water during the administration of a bath to an infant, toddler or disabled person, or in similar circumstances where the user may accidentally get wet from splashed water, such as during cleaning or washing.

The apron with attached towel 10 allows the caregiver to protect both the caregiver's body and clothing from inadvertently splashed water, while also carrying and transporting a towel 14, which is releasably fastened to apron 12 by releasable fastener 16, which may be a snap fastener, a hook and loop fastener, or any other suitable releasable fastener. Towel 14 is similar to a conventional towel and is formed of water-absorbent material, such as terry cloth or velour.

Apron 12 and towel 14 may have any desired size and contour. However, in the preferred embodiment, the apron 12 and towel 14 are dimensioned and configured so that apron 12 covers a substantial portion of the user's clothing in both the front and rear of the caregiver, and so that towel 14 may be wrapped around the person being bathed. Further, in the preferred embodiment, the apron 12 extends approximately between the caregiver's shoulders and the caregiver's knees.

Figure 2:
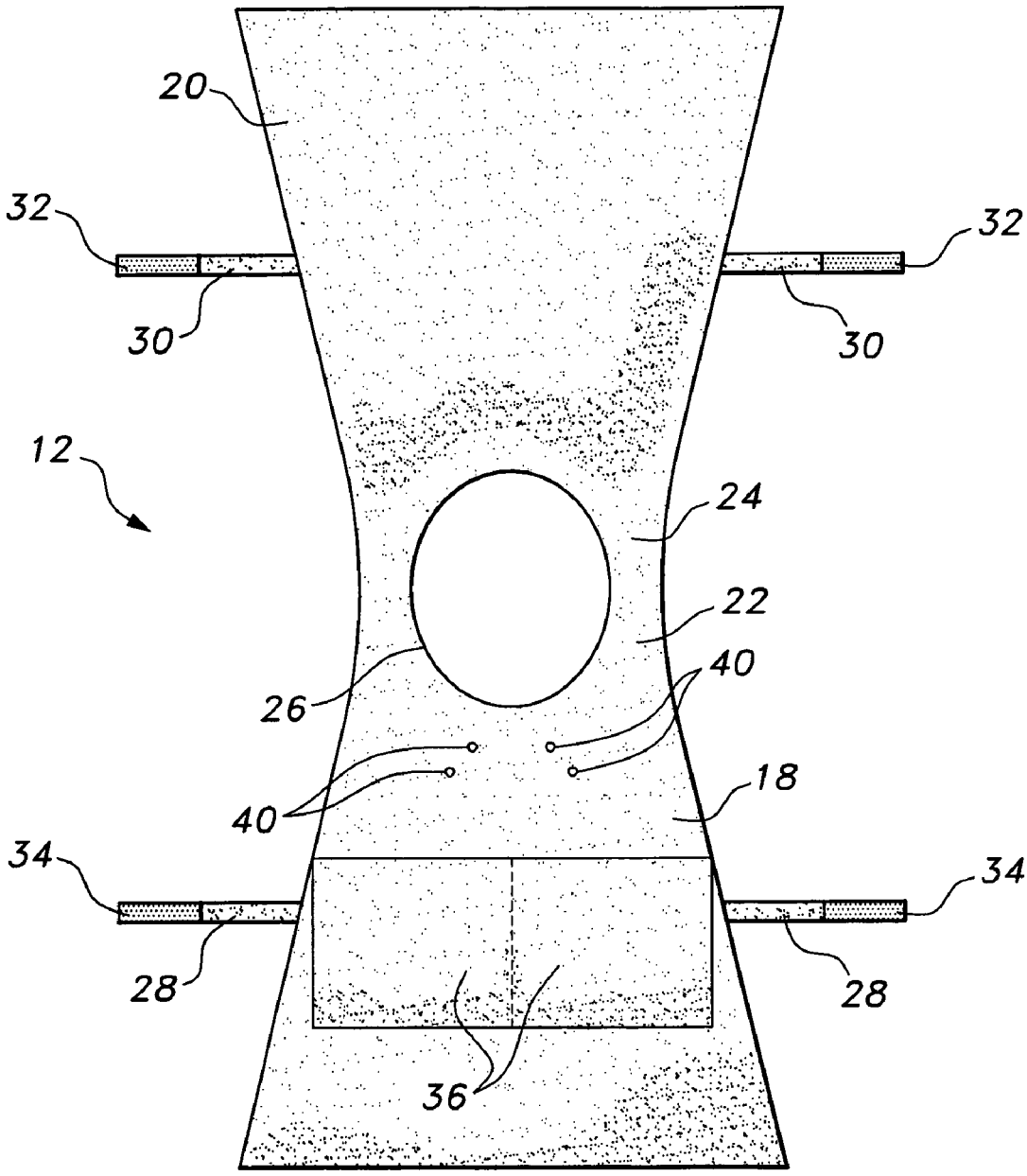
FIG. 2 is a top view of the apron according to the present invention, the towel being detached from the apron.

As shown in FIG. 2, apron 12 may include a front apron portion 18 or panel adapted for covering the front of the caregiver's torso, and a rear apron portion 20 or panel adapted for covering the caregiver's back. The front panel 18 includes an upper portion or bib for covering the user's chest or upper torso, and a lower portion or skirt for covering the user's lap. The apron 12 preferably also includes the rear panel 20, but may not include the rear panel 20 in some embodiments. Each of the apron portions 18, 20 includes an upper end, which are joined or integral with each other to form shoulder mounting regions 22, 24, respectively. When worn (as in FIG. 1), shoulder-mounting regions 22, 24 are positioned on the user's shoulders. As shown in FIG. 2, an opening 26 is formed between the shoulder mounting regions 22, 24 for receiving the user's head. Opening 26 is dimensioned and configured so that the user may comfortably insert his or her head and neck therethrough, while keeping the apron 12 positioned for protecting the user's clothing.

The front apron portion 18 includes a pair of opposed side edges. Each side edge has a front side strap 28 secured thereto and projecting outwardly therefrom. Each side strap 28 is flexible and is formed from fabric or the like. Similarly, the rear apron portion 20 also includes a pair of opposed side edges, and each side edge has a rear side strap 30 secured thereto and projecting outwardly therefrom. The front and rear side straps 28 and 30 preferably have first and second releasable closures 34, 32, respectively, secured thereto. First releasable closures 34 releasably engage second releasable closures 32, allowing the user to releasably and adjustably secure the front apron portion 18 to the rear apron portion 20 when apron 12 is worn by the user. Alternatively, front and rear side straps 28, 30 may be provided without closure elements, and the user may tie front and rear side straps 28, 30 together. As another alternative, apron 12 could be provided without side straps, and first and second releasable closures 34, 32 could be secured directly to the side edges of front and rear apron portions 18, 20, respectively.

As further shown in FIG. 2, one or more pockets 36 may be formed on front apron portion 12 for holding bath-related products and the like. Pockets 36 may be secured to front apron portion 18 through stitching or similar methods of attachment. In addition, the apron 12 may include indicia imprinted thereon for decorative or informative purposes.

Figure 3:
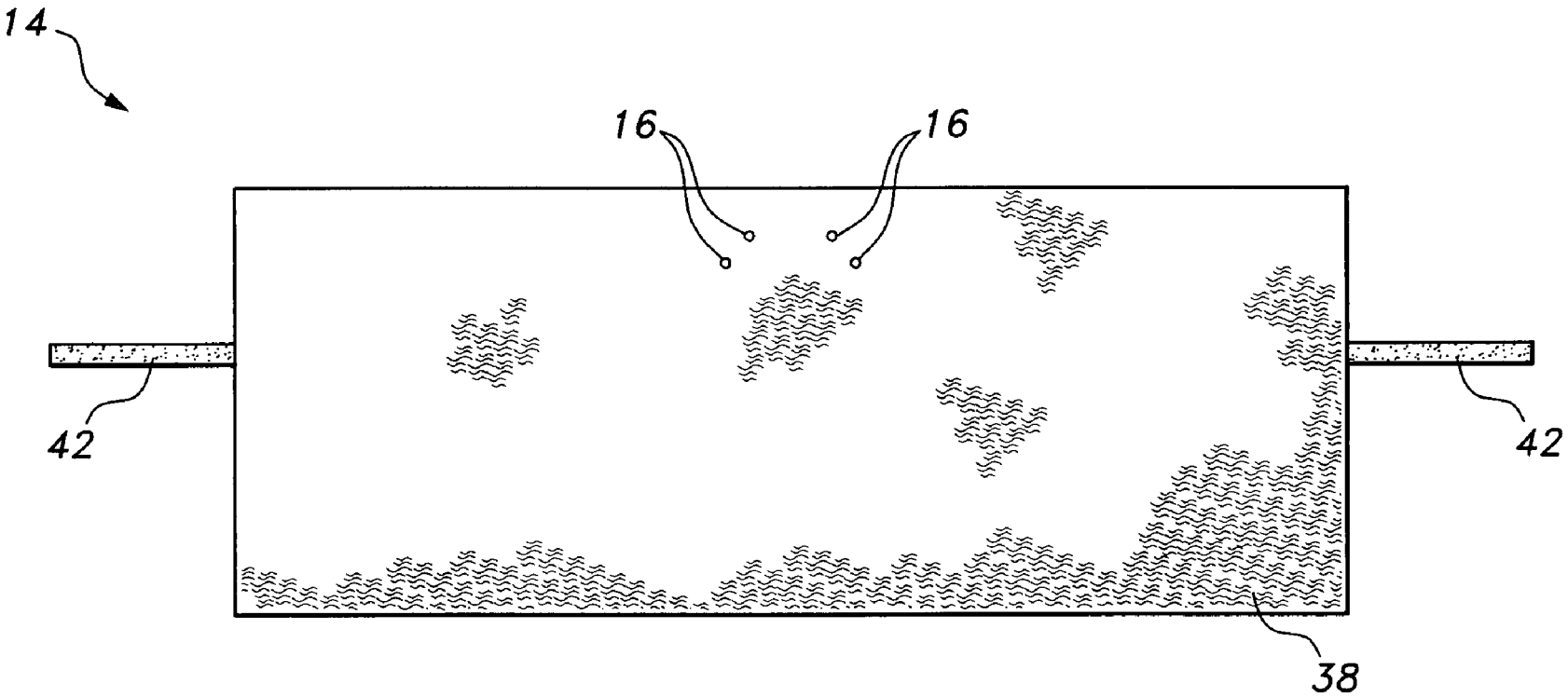
FIG. 3 is a top view of the towel of the water-resistant apron with attached towel according to the present invention.

Further, one or more releasable fasteners 40 are disposed on the front face of front apron portion 18, preferably on the bib portion of the front panel 18 adjacent the neck opening 20, as shown in FIG. 2, for quick and easy release of the towel 14 from the apron 12. As shown in FIG. 3, the towel 14 includes a main body portion 38 having one or more releasable fasteners 16 disposed adjacent a top edge thereof. Releasable fasteners 16 engage releasable fasteners 40 to selectively attach and detach the towel from the apron 12. Releasable fasteners 16, 40 may be snap fasteners, buttons, hook and loop fasteners or any other suitable releasable fasteners.

As further shown in FIG. 3, the main body 38 of towel 14 includes a pair of opposed side edges, and each side edge preferably has a strap 42 secured thereto and projecting outwardly therefrom. Straps 42 are flexible and are formed from a suitable material, such as fabric. When the apron 12 is worn by the caregiver, straps 42 allow the caregiver to wrap the towel 14 around himself or herself and secure the towel 14 in the wrapped position by tying the straps 42 together behind the user's back in order to prevent the towel 14 from hanging loosely.

The apron with attached towel 10 allows the caregiver to both protect his or her clothing from accidentally splashed water, and further provides for easily transporting and holding a towel. Through the selective attachment of towel 14 to apron 12, the caregiver may hold the towel securely, in close proximity to the user's hands, while still leaving both hands free for bathing or cleaning. Attachment of towel 14 to apron 12 provides the user with continuous and convenient access to the towel 14 and allows the user to avoid dropping the towel 14 or otherwise placing the towel 14 on unsanitary surfaces.

It is to be understood that the present invention is not limited to the embodiments described above, but encompasses any and all embodiments within the scope of the following claims.

We claim:

1. An apron with attached towel, comprising:
- a front panel having an upper portion defining a bib and a lower portion defining a skirt, the front panel forming an apron, an upper edge of the bib forming at least a portion of a neck opening;
- a rear panel having an upper portion joined to the upper portion of said front panel defining the neck opening and opposing shoulder straps;
- means for securing the front panel about a waist of a user, wherein said securing means includes:
  - a pair of straps extending from opposing sides of said front and rear panels, respectively; and
  - mating hook and loop fasteners attached to the straps;
- a fabric panel made from water absorbent material, the fabric panel defining a towel; and
- a pair of straps extending from opposing ends of the towel, whereby the towel is secured around the user's torso by tying the straps.

2. The apron with attached towel according to claim 1, further comprising:
- at least one first releasable fastener attached to the bib adjacent the neck opening; and
- at least one second releasable fastener attached to the towel, the second releasable fastener mating with the first releasable fastener in order to detachably secure the towel to the apron.

3. The apron with attached towel according to claim 2, wherein said first and second releasable fasteners are selected from the group consisting of mating snap fasteners and mating hook and loop fasteners.

4. The apron with attached towel according to claim 1,wherein said front panel is made from water-resistant material.

* * * * *